US009273273B2

(12) United States Patent
Fausnight et al.

(10) Patent No.: US 9,273,273 B2
(45) Date of Patent: Mar. 1, 2016

(54) VEHICLE WASH POD

(71) Applicant: ILLINOIS TOOL WORKS, INC., Glenview, IL (US)

(72) Inventors: Ronald Fausnight, Spring, TX (US); Liliana Minevski, The Woodlands, TX (US); Janice Crayton, Humble, TX (US); Bernard Asente, Glenview, IL (US)

(73) Assignee: ILLINOIS TOOL WORKS, INC., Glenview, IL (US)

( * ) Notice: Subject to any disclaimer, the term of this patent is extended or adjusted under 35 U.S.C. 154(b) by 181 days.

(21) Appl. No.: 13/836,577

(22) Filed: Mar. 15, 2013

(65) Prior Publication Data

US 2014/0274858 A1 Sep. 18, 2014

(51) Int. Cl.

| | |
|---|---|
| ***C11D 17/00*** | (2006.01) |
| ***C11D 1/835*** | (2006.01) |
| ***C11D 11/00*** | (2006.01) |
| ***C11D 17/04*** | (2006.01) |

(52) U.S. Cl.

CPC ..... *C11D 17/0039* (2013.01); *C11D 1/835* (2013.01); *C11D 11/0041* (2013.01); *C11D 17/043* (2013.01)

(58) Field of Classification Search

CPC ..... C11D 17/041
USPC ..... 510/296, 297, 439
See application file for complete search history.

(56) References Cited

U.S. PATENT DOCUMENTS

| | | | | |
|---|---|---|---|---|
| 4,972,017 | A * | 11/1990 | Smith et al. | 524/46 |
| 5,384,364 | A * | 1/1995 | Besse et al. | 510/231 |
| 5,534,178 | A * | 7/1996 | Bailly et al. | 510/367 |
| 7,507,699 | B2 * | 3/2009 | Burt et al. | 510/296 |
| 8,669,216 | B2 * | 3/2014 | Zhu | 510/108 |
| 2005/0143278 | A1 * | 6/2005 | Pegelow et al. | 510/439 |
| 2005/0153861 | A1 * | 7/2005 | Wiedemann et al. | 510/439 |
| 2006/0223736 | A1 * | 10/2006 | Lenhart et al. | 510/295 |
| 2008/0280806 | A1 * | 11/2008 | Bartelme et al. | 510/446 |
| 2008/0312123 | A1 * | 12/2008 | Weber et al. | 510/451 |
| 2013/0239995 | A1 * | 9/2013 | Johnson et al. | 134/28 |

* cited by examiner

*Primary Examiner* — Gregory Webb
(74) *Attorney, Agent, or Firm* — Blue Filament Law PLLC; Avery N. Goldstein

(57) ABSTRACT

A wash pod is provided that includes unit dose of anhydrous wash concentrate surfactant containing at least one cationic surfactant and at least one nonionic surfactant in water soluble hygroscopic polymeric package containing the concentrate. The film encapsulates the wash formula unit dose and dissolves when placed in a bucket of water while also being chemically and physically strong enough to hold a more preferred alkaline formula as well as to remain stable during storage is provided. A low volatile organic compound (VOC) car wash formula that is highly concentrated with a low water content and contains nonionic and cationic surfactants to promote cleaning, foaming and beading, while also containing a small amount of carnauba wax is also provided. The formulation of the car wash detergent provides a streak free low residue finish on a cleaned surface.

24 Claims, 3 Drawing Sheets

VEHICLE WASH POD

FIELD OF THE INVENTION

The present invention in general relates to detergents, and in particular to a unit dose of detergent in a water soluble package containing wash concentrate to develop a bucket of wash solution when immersed in cold water with particular application to vehicle exterior cleaning

BACKGROUND OF THE INVENTION

Presently, G-Clean™ produced by Green Earth Technologies, Inc. is the only known car wash detergent in a water rupturable packet. However, the G-Clean™ product is designed as a pressure wash detergent using high pressure equipment (up to 4,000 psi) and relies on a nanotechnology based plant oil derived hydrophobic cleaning solution. The G-Clean™ cleaner requires a high pressure injector unit and affords an incomplete vehicle exterior when applied with a sponge and rinsed with typical garden hose pressure water wash.

Holderbaum, et al. in U.S. Pat. No. 6,448,212 discloses a laundry/dishwasher detergent portion for use in automated washing machines, where the containment portions are water soluble. However, the temperatures at which the thermoplastic films of the detergent portions as taught by Holderbaum, et al. permeate, as well as the force applied, are higher than used in a car wash application involving only a bucket filled with by a municipal water supplied hose in a typical custom car wash setting of a home or a custom detailing shop.

Thus, there exists a need for encapsulated car wash detergents in the form of pods that eliminates the need for this specialized high pressure equipment and requires only a pail or other container to dissolve the product under a stream of municipal water supply obtained directly from a garden hose nozzle.

SUMMARY OF THE INVENTION

A wash pod is provided that includes unit dose of anhydrous wash concentrate surfactant containing at least one cationic surfactant and at least one nonionic surfactant in water soluble hygroscopic polymeric package containing the concentrate. Upon placement in water the pod ruptures to develop a bucket of foamy wash solution. A water soluble polymer film encapsulates or holds the car wash formula in the form of a pod or packet, where the film is thin enough to permeate while also being chemically and physically strong enough to hold a more preferred alkaline formula as well as to remain stable during storage is provided. A low volatile organic compound (VOC) car wash formula that is highly concentrated with low water content and contains nonionic and cationic surfactants to promote cleaning, foaming and beading, while also containing a small amount of carnauba wax is also provided. The formulation of the car wash detergent provides a streak free low residue finish on a cleaned surface. A process of for using the pod to wash a surface is also provided.

BRIEF DESCRIPTION OF THE DRAWINGS

The subject matter that is regarded as the invention is particularly pointed out and distinctly claimed in the claims at the conclusion of the specification. The foregoing and other objects, features, and advantages of the invention are apparent from the following detailed description taken in conjunction with the accompanying drawings in which:

Figure 1:
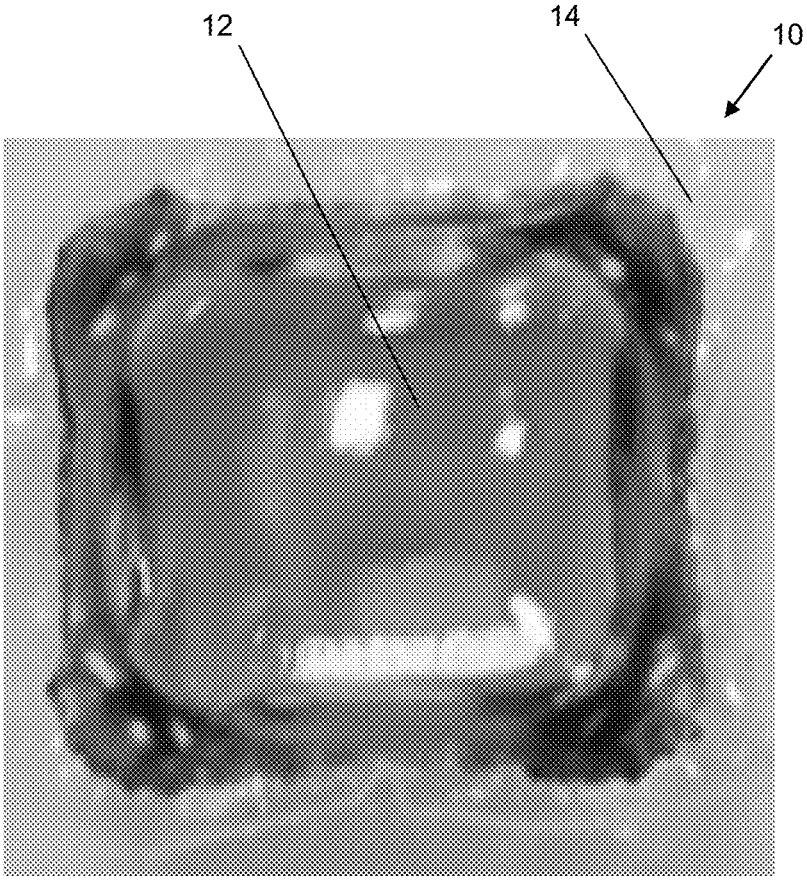
FIG. 1 illustrate a top perspective view of a car wash detergent in the form of a pod with a water soluble encapsulation skin according to embodiments of the invention.

The detailed description explains the preferred embodiments of the invention.

DETAILED DESCRIPTION OF THE INVENTION

The present invention has utility as a wash concentrate encapsulated in a unit dose water soluble package or pod that develops a bucket of foamy wash when combined with water. While the present invention is detailed herein largely in the context of a premeasured unit dose for a vehicle of a car or pickup truck, it is appreciated that the resultant wash solution formed by dissolving an inventive pod in water is equally well-suited for cleaning of other vehicles, buildings, decks, windows, and pavement. Embodiments of the invention have a water soluble polymer film that encapsulates or holds the car wash formula in the form of a pod or packet, where the film is thin enough to permeate while also being chemically and physically strong enough to hold a more preferred alkaline formula as well as to remain stable during storage. Pods are stored in a sealed package as to be protected from ambient conditions, humidity and impact while transport and shelving. A sealed package is mandatory for long term storage or where humidity is high but limited exposure of pod itself to ambient air in a cool dry (air conditioned) environment is acceptable. The packaging of the inventive car wash in a pod form, eliminates spills from a jug of car wash fluid, as well as providing a light and easy to store car wash detergent that does not require pre-measuring before use, which improves upon the convenience of other liquid car wash concentrates because it allows handling a single dose with no need to measure, carry and pour from a large liquid container. This eliminates spills and waste due to over dosing when pouring a liquid into a bucket. Embodiments of the invention eliminate the need for specialized high pressure equipment and require only a pail or other container to dissolve the product under a stream of water directly from a hose nozzle or tap.

It is to be understood that in instances where a range of values are provided that the range is intended to encompass not only the end point values of the range but also intermediate values of the range as explicitly being included within the range and varying by the last significant figure of the range. By way of example, a recited range of from 1 to 4 is intended to include 1-2, 1-3, 2-4, 3-4, and 1-4.

Embodiments of the inventive car wash formula provide a low volatile organic compound formula that is highly concentrated with low water content and contains nonionic and cationic surfactants to promote cleaning, foaming and beading, while also containing a small amount of carnauba. Low water content in embodiments of the car wash formulation is preferred so as to not violate or compromise the integrity of the water soluble polymer holding the formulation. Embodiments of the inventive formulation of the car wash detergent also provide a streak free low residue finish on a cleaned surface.

In embodiments of the inventive car wash pod, the water soluble polymer holding the formulation is a polyvinyl alcohol (PVA) film that is used to form and seal the pod. The PVA film is between 0.037 and 0.127 mm thick with a colorless clear, shiny finish. In certain embodiments, the film is formed to have a tensile strength at 23° C. and 50% relative humidity of at least 45 N/(mm)$^2$ and an elongation of greater than 500%, both as measured by ASTM D882. The surfactant volume in the pod that constitutes a unit dose for washing a vehicle ranges from 5 to 50 milliliters (ml) and ideally less than 12 ml to facilitate surfactant need in approximately one gallon of water. The size of the unit dose depends on factors including the surfactant properties of the unit dose, and the surface area of the vehicle.

The film is hygroscopic and readily absorbs water. The hygroscopic type of film requires the contained car wash formula to be anhydrous and have less than 2% and ideally less than 1% water as measured by Karl Fischer test method, water to avoid premature permeation of the film. Thus, the car wash formulation is highly concentrated with no added water. During production, shipping and storage the concentrated liquid car wash formula contacts the interior surface of the water soluble film. FIG. 1 shows an embodiment of a pod generally shown at 10 with a car wash detergent 12 encapsulated in a water soluble skin 14.

Embodiments of the low volatile organic compound (VOC) car wash formula are highly concentrated, and contain nonionic and cationic surfactants to promote cleaning, foaming and beading with a small amount of wax. The water content is measured using American Society for Testing and Materials (ASTM) E1064 Karl Fischer method. It is appreciated that a variety of commercially available cationic surfactants and nonionic surfactant are operative herein as long as the overall unit dose water content remains anhydrous and ideally below 2 wt. %. As used herein, "anhydrous" is defined as a water content of less 2 wt. %. In a specific inventive embodiment, the cationic surfactant is a quaternary ammonium terminated surfactant that is present from 1 to 45 wt. %. Cationic surfactants operative herein includes trimethylalkylammonium chlorides, and the chlorides or bromides of benzalkonium and alkylpyridinium ions; with a specific example being a 5 wt, % of a 1000 centistokes cationic dicoco dimethyl ammonium chloride and promotes water beading. An ionic surfactant is selected in certain embodiments on the basis of low VOC levels. In certain jurisdictions, the level of the cationic surfactant in the formulation is limited to 5% due to the California Air Resources Board volatile organic compound (CARB VOC) limit for car wash of 0.2 wt. %.

Dicoco dimethyl ammonium chloride is from the family of quaternary amines with general formula $(NR_4)^+Cl^-$ and shown below as Formula 1. The two R groups are methyl ($CH_3$) groups and the other two R groups are constituents of coconut oil, a mix of fatty acids, $CH_3(CH_2)_nCH_2COOH$ where n=5, 7, 9, 11, 13, 15. Fatty acids represented in coconut oil are, from the highest to lowest concentration, lauric acid ($C_{12}H_{24}O_2$), myristic acid ($C_{14}H_{28}O_2$), palmitic acid ($C_{16}H_{32}O_2$), caprylic acid ($C_8H_{16}O_2$), caprioic acid ($C_6H_{12}O_2$), oleic acid ($C_{18}H_{34}O_2$), stearic acid ($C_{18}H_{36}O_2$), and linoleic acid ($C_{18}H_{32}O_2$). A typical coconut oil analysis indicates high content of saturated fat: $C_{12}$ 46.5%, $C_{14}$ 20.6%, $C_{16}$ 9.1%, $C_{8\text{-}6.6}$% and $C_{18}$ 2.9% as well as some monosaturated fat: $C_{18}$ 7.2%.

Formula 1

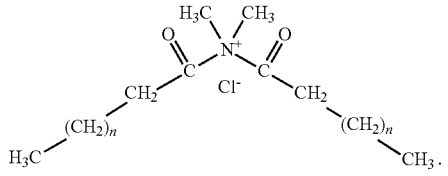

$n$ = 5, 7, 9, 11, 13, 15

In certain embodiments of the present invention, a first nonionic surfactant is present from 5 to 95 wt. % and is at least one of a fatty alcohol, cetyl alcohol, stearyl alcohol, and cetostearyl alcohol that is predominantly composed of cetyl and stearyl alcohols, and oleyl alcohol, polyoxyethylene fatty acid alkanolamides, alkanolamide alcoholamines, polyethylene glycols of the aforementioned, $C_2$-$C_6$ alkoxyls of the aforementioned, $C_2$-$C_6$ polyalkoxyls of the aforementioned, and combinations thereof. In a specific example ethoxylated linear alcohol helps clean the road grime and dirt residue due to excellent wetting agent, emulsifier, and detergent characteristics; a cocamide diethanolamine (DEA) and brings excellent emulsifying properties and good foam stability; or a combination thereof. An exemplary unit dose includes 40-70 wt. % ethoxylated linear alcohol and 25-55 wt. % cocamide diethanolamine.

In still other embodiments, an additional nonionic ingredient is a carnauba/paraffin wax blend emulsion containing a phase of pure carnauba wax is also present. Such an emulsion, if present, is used in amounts of from 0.001 to 2 wt. %. It is appreciated that a unit does of surfactant according to the present invention may also include a dye, such as 0.01 wt % of Chromatint Blue 0408, which is dispersed and added for the esthetic appearance of the formulation; a desiccant such as a salt that forms a hydrate to sequester spurious water in the surfactant formulation.

In embodiments while the pod must remain intact without weakening to store the car wash liquid until it is needed, the encapsulation film must dissolve quickly when water is added, generate foam, and dissolve/perform as the consumer would expect from any liquid car wash without leaving a film residue that compromises the shine quality imparted to the vehicle exterior. Water temperature is an important contributor to permeation time of the encapsulation film of the car wash pod. Time of permeation of the encapsulation film or skin is much faster at temperatures greater than 20° C. compared to temperatures below 20° C., as will be shown in the examples to follow. Warm or hot water works very well, while cool water is slower, but acceptable. Ice cold water is too slow and a pail fills with water before permeation of the car wash pod occurs. Once the pail is full the lack of agitation will not produce any foam absent mechanical agitation.

The present invention is further detailed with respect to the following non-limiting comparative and inventive examples. These examples are not intended to limit the scope of the appended claims.

The following examples illustrate performance parameters for embodiments of the inventive car wash pod. In the following examples pod permeation is tested, and once a pods film is exposed to water, the film begins absorbing the water and softens to burst and release the car wash contents.

EXAMPLE 1

Figure 2A:
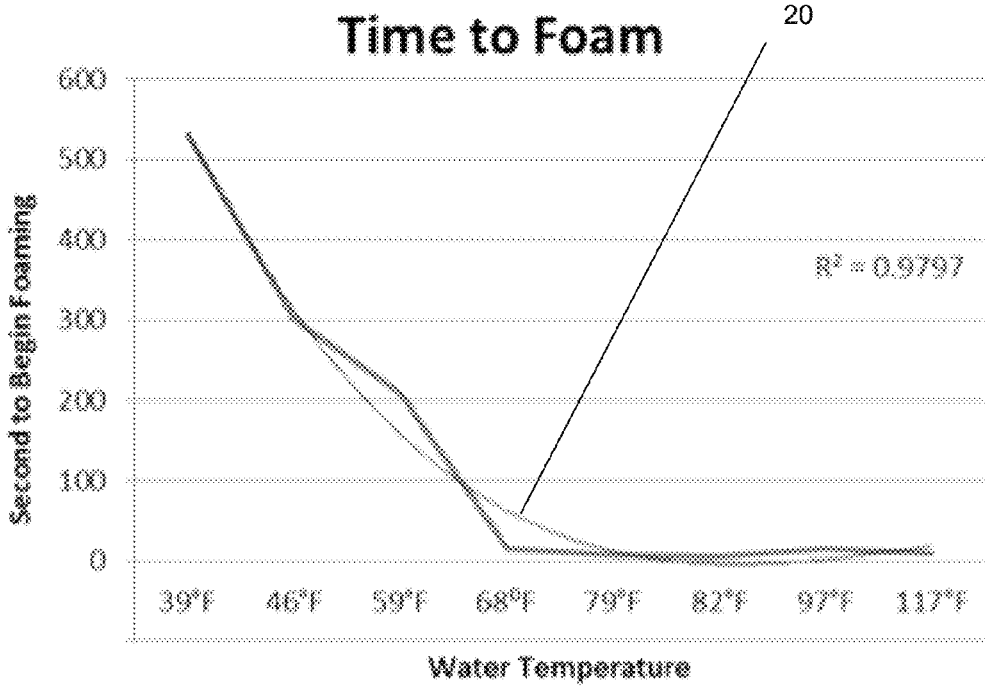
FIG. 2A illustrates a graph of time to foam versus the water temperature of the inventive car wash pod of FIG. 1.
Figure 2B:
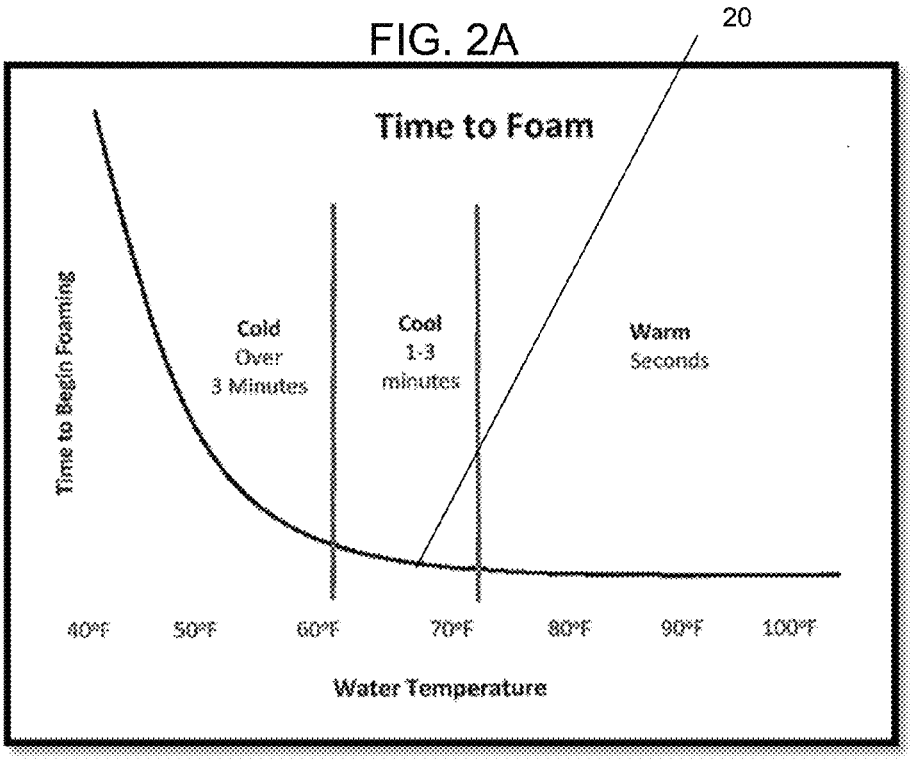
FIG. 2B illustrates a graphical interpretation of the graph of FIG. 2A showing three generalized regions of water temperature cold, cool, and warm with time to foam of the inventive pod when water is introduced.

FIG. 2A illustrates a graph of time to foam versus the water temperature of the inventive car wash pod of FIG. 1. As shown in the graph of FIG. 2A the time to permeate and produce foam increases rapidly as the temperature decreases and approaches freezing. The times (Y-axis) are in seconds to begin foaming as measured from the beginning of the water addition to a dry pod in a dry pail. Water is added at various temperatures. Because no chiller is available for the tap water used with the hose, the colder samples are refrigerated and mixed with tap water to adjust to the temperature. The water is then poured from a 5 foot height to provide a strong stream of water up to a total of two gallons. Some of the colder samples below 60° F. required additional agitation beyond the water addition to effect permeation. When temperatures higher than the ambient water temperature are added using a strong stream of water from a tap where hot and cold water are mixed. The line 20 approximates a polynomial function and the curve indicates that at temperatures above about 70° F. the pod film dissolves much faster than samples closer to freezing. The chart is simplified in FIG. 2B to showing three generalized regions of water temperature cold, cool, and warm with time to foam of the inventive pod when introduced to water.

EXAMPLE 2

A laboratory procedure is used to determine repeatability at each temperature measured. Pods are placed in a 4-liter beaker containing about 3500 ml of water agitated by a stir bar to produce a strong vortex without reaching the stir bar itself. A range of temperatures from 4° C. (39.2° F.) to 50° C. (122° F.) are used with a single pod added and timed to permeation. The determination is replicated four times at each temperature using fresh water and a new pod for each trial. The results are tabulated below in table 1.

TABLE 1

Temperature Vs Foam Data

| | Time to Begin Foaming in Seconds | | | | | | | | |
|---|---|---|---|---|---|---|---|---|---|
| Temp. | 4° C. | 7° C. | 10° C. | 15° C. | 20° C. | 25° C. | 30° C. | 35° C. | 50° C. |
| Trial 1 | 380.0 | 323.0 | 265.0 | 210.0 | 190.0 | 132.0 | 75.0 | 72.0 | 44.0 |
| Trial 2 | 510.0 | 314.0 | 243.0 | 203.0 | 157.0 | 98.0 | 85.0 | 67.0 | 50.0 |
| Trial 3 | 386.0 | 295.0 | 256.0 | 227.0 | 171.0 | 140.0 | 79.0 | 76.0 | 46.0 |
| Trial 4 | 408.0 | 320.0 | 258.0 | 222.0 | 183.0 | 110.0 | 74.0 | 63.0 | 44.0 |
| Average | 421.00 | 313.00 | 255.50 | 215.50 | 175.25 | 120.00 | 78.25 | 69.50 | 46.00 |
| Std Dev | 60.542 | 12.570 | 9.183 | 10.970 | 14.477 | 19.391 | 4.992 | 5.686 | 2.828 |

Figure 3:
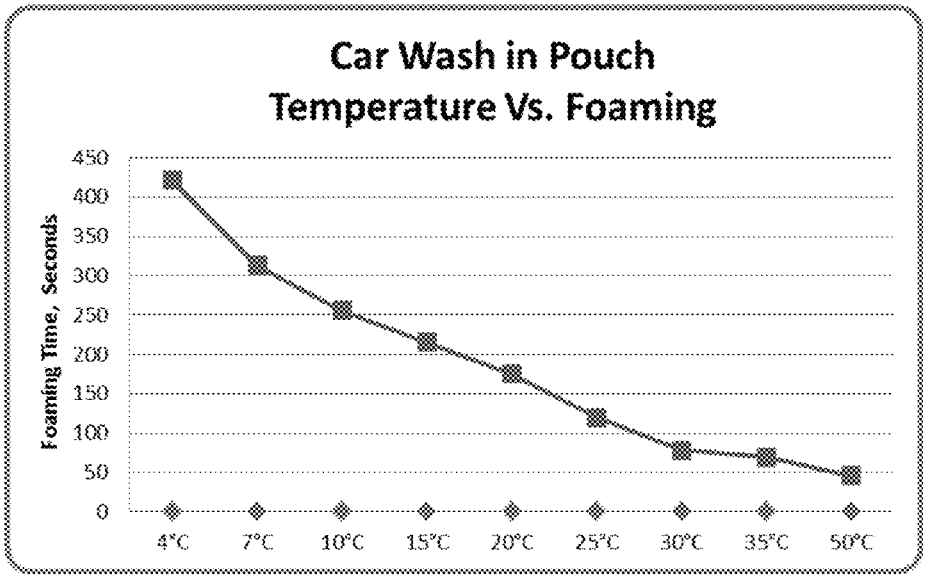
FIG. 3 illustrates a graph of temperature versus foaming of the inventive car wash pod of FIG. 1 for the average time to permeate for each temperature.

The time to penetrate the film is longer using a stirrer compared to a hose spray across all the temperatures except possibly the coldest. The gentle action of the mixing appears to slow the penetration. There is no overlap in the range of each set of data points from temperature to temperature except for the 30° C. (86° F.) group and the 35° C. (95° F.) group. Clearly permeation time depends on temperature. FIG. 3 illustrates the average time to permeate for each temperature.

The following examples relate to the determination to the durability of the thin PVA film durability. Deterioration of the PVA film with liquid is a concern because of the need for long term storage compatibility of the car wash pods, and the need to permeate as quickly as possible when the pod is wet in a pail, but not due to condensation or humidity. The durability is evaluated in several ways.

EXAMPLE 3

Samples are tested in the 50° C. laboratory oven. Individual filled pods with no additional package or outer barrier are placed on a spill pan in a temperature chamber at 50° C. Individual pods are pre weighed and three pod samples are maintained at room temperature as controls and an additional 12 pods are placed in the temperature chamber. The pods are observed weekly and weighed for loss of material. The results are tabulated below in table 2.

TABLE 2

Weight Change at 50° C. (0.5 oz Pods)

| Sample | Initial Wt. | 7 Days | 14 Days | 21 Days | 28 Days | % wt. loss |
|---|---|---|---|---|---|---|
| 1 Control | 15.6 | 15.6 | 15.8 | 15.8 | 15.9 | −1.92% |
| 2 Control | 15.6 | 15.6 | 15.8 | 15.8 | 15.9 | −1.92% |
| 3 Control | 15.7 | 15.6 | 15.8 | 15.8 | 15.9 | −1.27% |
| 4 | 15.6 | 15.4 | 15.3 | 15.3 | 15.4 | 1.28% |
| 5 | 15.6 | 15.4 | 15.3 | 15.3 | 15.4 | 1.28% |
| 6 | 15.6 | 15.4 | 15.3 | 15.3 | 15.4 | 1.28% |
| 7 | 15.6 | 15.4 | 15.3 | 15.3 | 15.4 | 1.28% |
| 8 | 15.6 | 15.4 | 15.3 | 15.3 | 15.4 | 1.28% |
| 9 | 15.6 | 15.3 | 15.3 | 15.3 | 15.4 | 1.28% |
| 10 | 15.6 | 15.4 | 15.3 | 15.3 | 15.4 | 1.28% |
| 11 | 15.6 | 15.4 | 15.3 | 15.3 | 15.4 | 1.28% |
| 12 | 15.6 | 15.4 | 15.3 | 15.3 | 15.4 | 1.28% |
| 13 | 15.6 | 15.4 | 15.3 | 15.3 | 15.4 | 1.28% |
| 14 | 15.6 | 15.4 | 15.3 | 15.3 | 15.4 | 1.28% |
| 15 | 15.7 | 15.4 | 15.3 | 15.3 | 15.4 | 1.91% |

Weight losses at 50° C., even with no additional outer product packaging for protection from ambient humidity ranged from 1.28% to 1.91%. There is no loss of integrity noted in the pods. The pod pouches at room temperature gained weight due to the hygroscopic polyvinyl alcohol film used to make the pouches, which absorbs humidity from the atmosphere.

Another internal test at 50° C. is performed with pouches sealed in two versions of the Stand-Up Pouch (SUP). One SUP is prepared using the specified film and thickness 48 gauge (0.048") with a bi-layer of PET and LLDPE400. One layer of the film is polyethylene terephthalate and the other is linear low density polyethylene. Two additional pouches are tested using a different softer film at the same thickness of 48 gauge. This film used only a layer of polyethylene. The tabulated results are shown in table 3.

TABLE 3

Weight Change at 50° C. (0.4 oz. Pods)

| Pouch# | 0 days Aug. 8, 2012 | 7 days Sep. 4, 2012 | 14 days Sep. 11, 2012 | 21 days Sep. 18, 2012 | 28 days Sep. 26, 2012 | % Wt. Loss |
|---|---|---|---|---|---|---|
| Standard SUP | 197.4 | 196.9 | 196.4 | 196.1 | 195.8 | 0.81 |

TABLE 3-continued

| Weight Change at 50° C. (0.4 oz. Pods) | | | | | | |
|---|---|---|---|---|---|---|
| Pouch# | 0 days Aug. 8, 2012 | 7 days Sep. 4, 2012 | 14 days Sep. 11, 2012 | 21 days Sep. 18, 2012 | 28 days Sep. 26, 2012 | % Wt. Loss |
| #1 Poly SUP | 190.2 | 189.5 | 188.9 | 188.7 | 188.3 | 1.00 |
| #2 Poly SUP | 190.4 | 189.7 | 189.0 | 188.7 | 188.4 | 1.05 |

Weight loss is acceptable at 0.8% for the standard SUP. The poly SUP's are also acceptable, below the limit of 2%, but lose slightly more weight than the thicker pouch.

EXAMPLE 4

Samples are taken through freeze-thaw cycles. The pods are placed in the laboratory freezer, frozen solid and then allowed to thaw at room temperature. The pods are in an open beaker and are exposed to the air. While the pods are still cold, frost formed on their surfaces. The pods are allowed to warm to room temperature and observed. There are no visible or tactile changes noted. The pods are again frozen in the freezer until solid and went through five cycles. After five cycles the pods are held at room temperature (air conditioned) in an open beaker. After several weeks the pods are still intact with no visible signs of deterioration.

EXAMPLE 5

Samples are stored outside in an exposure/weathering test box through daily changes in heat and humidity. A soft polyethylene bag consisting of a two layers LDPE and PET is sealed using a zip-lock closure. The pouch is examined for changes in appearance weekly for 28 days. There is no change noted as shown in table 4.

TABLE 4

| Initial Test - Physical Change in Outside Test Box (0.5 oz/14.79 ml Pods) | | | | | |
|---|---|---|---|---|---|
| Pouch# | 0 days | 7 days Jun. 26, 2012 | 14 days Jul. 3, 2012 | 21 days Jul. 10, 2012 | 28 days Jul. 17, 2012 |
| 1 Pouch | Std appear. | No Change | No Change | No Change | No Change |

The test is repeated using an SUP made of LDPE-PET bi-layer bag, but with less thickness than the specified bag. The bi-layer bag is sealed with a zip lock closure. The pouch is weighed full with 15 0.4-oz./11.83 ml pods and reweighed as a whole. Humidity is also monitored during this test. There is a slight weight gain, probably due to high humidity, but pouch integrity appeared normal. The details are in the table 5 below.

TABLE 5

| Weight Change in Outside test box (0.4 Pods) | | | | | | |
|---|---|---|---|---|---|---|
| Pouch# | 0 Days Aug. 29, 2012 | 7 days Sep. 5, 2012 | 14 days Sep. 12, 2012 | 21 days Sep. 19, 2012 | 28 days Sep. 27, 2012 | % Diff |
| 1 Pouch | 189.9 | 190.6 | 190.8 | 191.4 | 191.4 | 0.79% gain |
| Relative Humidity | N/A | 50.1% | 76.5% | 79.3% | 40.1% | — |

EXAMPLE 6

Samples maintained at room temperature. Samples have been held for 10 months and there have been no pouch failures due to humidity or incompatibility with the formula.

The foregoing description is illustrative of particular embodiments of the invention, but is not meant to be a limitation upon the practice thereof. The following claims, including all equivalents thereof, are intended to define the scope of the invention.

The invention claimed is:

1. A car wash pod comprising:

a unit dose of anhydrous liquid wash concentrate surfactant containing at least one cationic surfactant and at least one nonionic surfactant, said at least one cationic surfactant is a quaternary ammonium surfactant that is present from 1 to 45 weight percent;

carnauba wax; and a water soluble hygroscopic polymeric film that forms a pouch of said car wash pod package encapsulating said unit dose of said anhydrous liquid wash concentrate surfactant and said carnauba wax.

2. The car wash pod of claim 1 wherein said unit dose is sized to wash a car or pick-up truck.

3. The car wash pod of claim 1 wherein said package is formed of a polyvinyl alcohol (PVA) film.

4. The car wash pod of claim 3 wherein said PVA film is from 0.038 to 0.127 mm thick.

5. The car wash pod of claim 3 wherein said unit dose of said anhydrous liquid wash concentrate surfactant is less than 1 weight percent water.

6. The car wash pod of claim 1 wherein said anhydrous liquid wash concentrate surfactant is a low volatile organic compound formula.

7. The car wash pod of claim 1 wherein said cationic and nonionic surfactants are a majority by weight of said unit dose.

8. The car wash pod of claim 1 wherein said nonionic surfactant is present from 5 to 95 weight percent.

9. The car wash pod of claim 1 wherein said car wash anhydrous liquid concentrate further comprises a dye.

10. The car wash pod of claim 1 wherein said unit dose is between 5 and 50 ml.

11. A process of washing a surface comprising:

adding the pod according to claim 1 to a bucket; and adding water to said bucket with agitation to create a foamy liquid for application to the surface.

12. The process of claim 11 wherein the water is added through a hose operating at municipal water supply pressure.

13. The process of claim 12 wherein the water exiting the hose provides the agitation.

14. The process of claim 11 further comprising storing the pod in sealed packaging for at least one month prior to addition to the bucket.

15. A car wash pod comprising:

a unit dose of anhydrous liquid wash concentrate surfactant containing at least one cationic surfactant, at least one nonionic surfactant, said at least one cationic surfactant is a quaternary ammonium surfactant that is present from 1 to 45 weight percent;

carnauba wax;

a water soluble hygroscopic polymeric film that forms a pouch of said car wash pod package encapsulating said unit dose of said anhydrous liquid wash concentrate surfactant and said carnauba wax; and a carnauba/paraffin wax blend emulsion containing a phase of pure carnauba wax.

16. The car wash pod of claim 15 wherein said unit dose is sized to wash a car or pick-up truck.

17. The car wash pod of claim 15 wherein said package is formed of a polyvinyl alcohol (PVA) film.

18. The car wash pod of claim 17 wherein said PVA film is from 0.038 to 0.127 mm thick.

19. The car wash pod of claim 17 wherein said unit dose of said anhydrous liquid wash concentrate surfactant is less than 1 weight percent water.

20. The car wash pod of claim 15 wherein said anhydrous liquid wash concentrate surfactant is a low volatile organic compound formula.

21. The car wash pod of claim 15 wherein said cationic and nonionic surfactants are a majority by weight of said unit dose.

22. The car wash pod of claim 15 wherein said nonionic surfactant is present from 5 to 95 weight percent.

23. The car wash pod of claim 15 wherein said car wash anhydrous liquid concentrate further comprises a dye.

24. The car wash pod of claim 15 wherein said unit dose is between 5 and 50 ml.

* * * * *